US009067700B1

(12) United States Patent
Middleton

(10) Patent No.: US 9,067,700 B1
(45) Date of Patent: Jun. 30, 2015

(54) TRASH BAG OPENER

(71) Applicant: Jerry L. Middleton, Indianapolis, IN (US)

(72) Inventor: Jerry L. Middleton, Indianapolis, IN (US)

( * ) Notice: Subject to any disclaimer, the term of this patent is extended or adjusted under 35 U.S.C. 154(b) by 0 days.

(21) Appl. No.: 14/249,546

(22) Filed: Apr. 10, 2014

(51) Int. Cl.
*B65B 67/04* (2006.01)
*B65B 67/12* (2006.01)

(52) U.S. Cl.
CPC ..... *B65B 67/1238* (2013.01)

(58) Field of Classification Search
CPC ..... B65B 39/08
USPC ..... 248/97, 99, 100, 101, 147, 151, 152, 248/907
See application file for complete search history.

(56) References Cited

U.S. PATENT DOCUMENTS

| | | | | |
|---|---|---|---|---|
| 3,468,505 | A * | 9/1969 | Reilly | 248/101 |
| 4,955,566 | A * | 9/1990 | Bolich | 248/101 |
| 5,020,751 | A * | 6/1991 | Larkin | 248/99 |
| 5,836,553 | A * | 11/1998 | Bergaila | 248/99 |
| 5,913,496 | A * | 6/1999 | Valdez | 248/99 |
| 6,250,492 | B1 | 6/2001 | Verbeek | |
| 6,416,023 | B1 * | 7/2002 | Satsky | 248/99 |
| 7,883,062 | B2 | 2/2011 | Zima | |
| 8,458,866 | B2 | 6/2013 | Hancz | |

* cited by examiner

*Primary Examiner* — Gwendolyn W Baxter
(74) *Attorney, Agent, or Firm* — Crossley Patent Law

(57) ABSTRACT

A trash bag opener that removably locks an existing trash bag open circularly at the bag's opening, supports that circular opening, provides a handle, and provides ease of bag removal.

2 Claims, 5 Drawing Sheets

TRASH BAG OPENER

BACKGROUND OF THE INVENTION

Various types of trash bag devices that help to handle unwieldy bags are known in the prior art. Trash bags are notoriously flimsy, collapse in the wind, and virtually never stay open when needed. Many devices that are designed to assist are not sufficiently supportive and can often tear a bag easily. What is needed is a trash bag opener that removably locks a bag open circularly at the bag's opening, supports that circular opening, provides a handle, and provides ease of bag removal.

FIELD OF THE INVENTION

The present invention relates to trash bag handling, and more particularly, to a trash bag opener that removably locks a bag open circularly at the bag's opening, supports that circular opening, provides a handle, and provides ease of bag removal.

SUMMARY OF THE INVENTION

The general purpose of the present trash bag opener, described subsequently in greater detail, is to provide a trash bag opener which has many novel features that result in a trash bag opener which is not anticipated, rendered obvious, suggested, or even implied by prior art, either alone or in combination thereof.

To accomplish this, the present trash bag opener includes a circular upper ring. The upper ring is a flat ring. An extrusion is extended from an approximate center of a bottom of the upper ring. A pair of diametrically opposed lock extensions is extended perpendicularly downward from an exterior edge of the upper ring. A tab is extended laterally inward from a bottom of each lock extension. An upwardly disposed rounded edge is disposed on each tab.

A circular lower ring is provided. The lower ring is a flat ring. A groove is disposed in a top of the lower ring. The groove is configured to removably accept the extrusion for positive engagement of the upper ring with the lower ring. Engagement of the extrusion with the groove, with an existing trash bag between, provides for firmly selectively securing the existing trash bag as desired. A skirt is disposed perpendicularly downward from an outer perimeter of the lower ring. A concavity is disposed within the skirt. The concavity is configured to removably retain the tabs wherein the upper ring and lower ring are selectively mated. The concavity and the tabs thereby selectively hold the upper ring to the lower ring. The rounded edges importantly provide ease of engagement and release of the tabs with regard to the concavity.

A handle is provided. The handle includes a pair of identical spaced apart upwardly angled upper arms. Each upper arm is connected to the upper ring. Each upper arm is spaced apart from a horizontally disposed lower arm. The handle is disposed centrally between the lock extensions. A verticality connects each upper arm to each lower arm. A rounded corner connects each verticality to each lower arm. A grip connects the verticalities at an approximate top of the verticalities. The upper arms, verticalities, and lower arms are importantly flat sided to aid in strength. A pair of identical spaced apart ears is disposed on the lower ring. Each ear is in pivotal receipt of one of the lower arms, respectively, wherein the upper ring is configured to pivotally engage and disengage the lower ring, thereby selectively entrapping and releasing, respectively, an existing trash bag.

Thus has been broadly outlined the more important features of the present trash bag opener so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
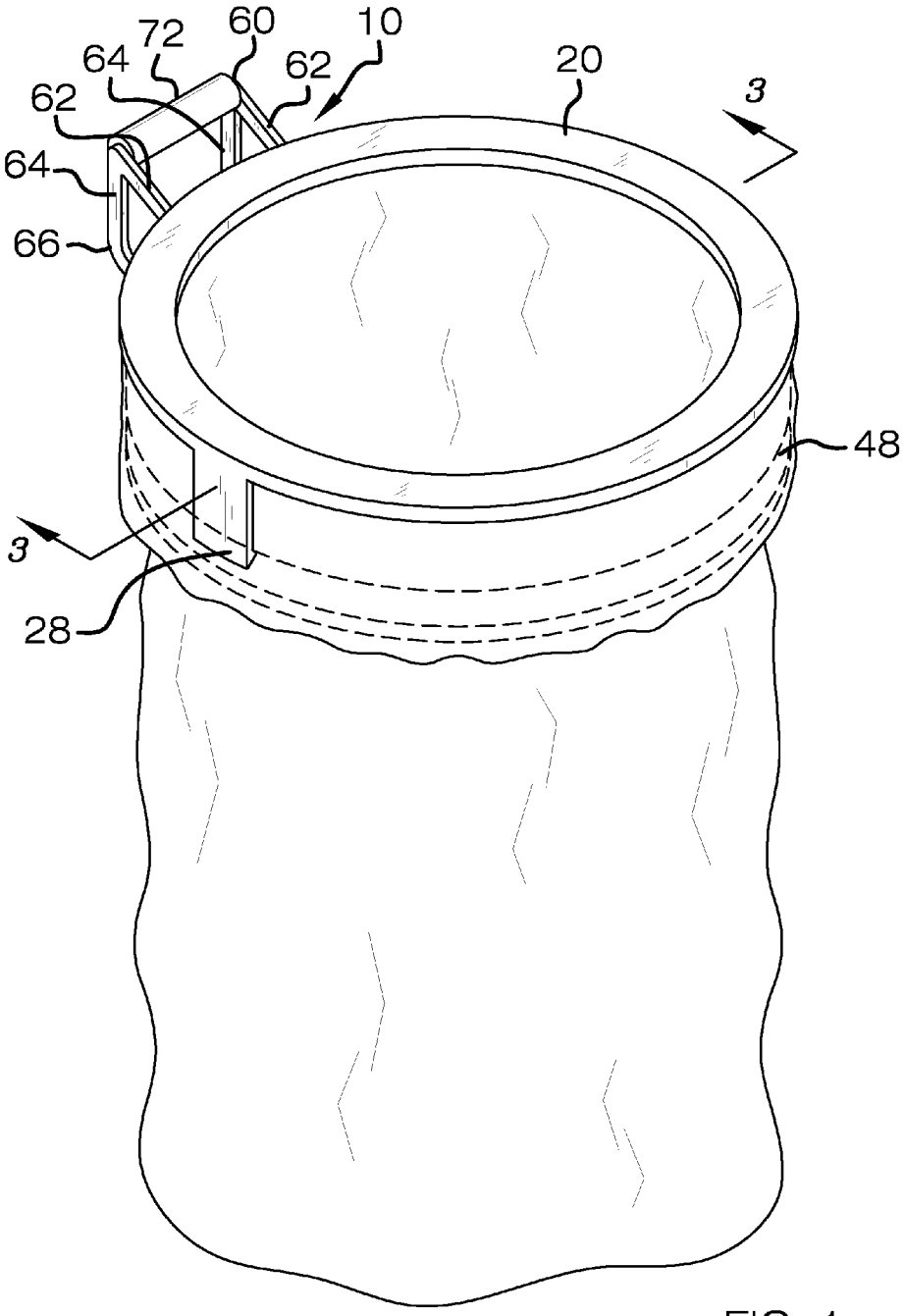
FIG. 1 is a perspective in-use view.
Figure 2:
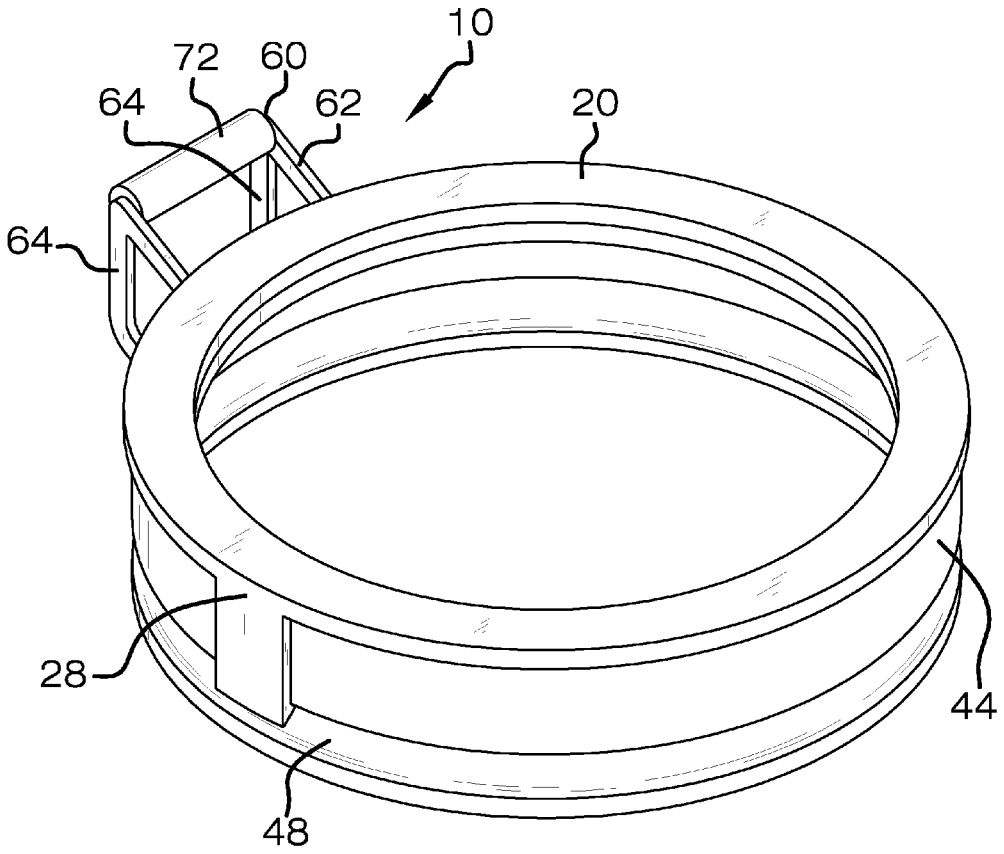
FIG. 2 is a perspective view.
Figure 3:
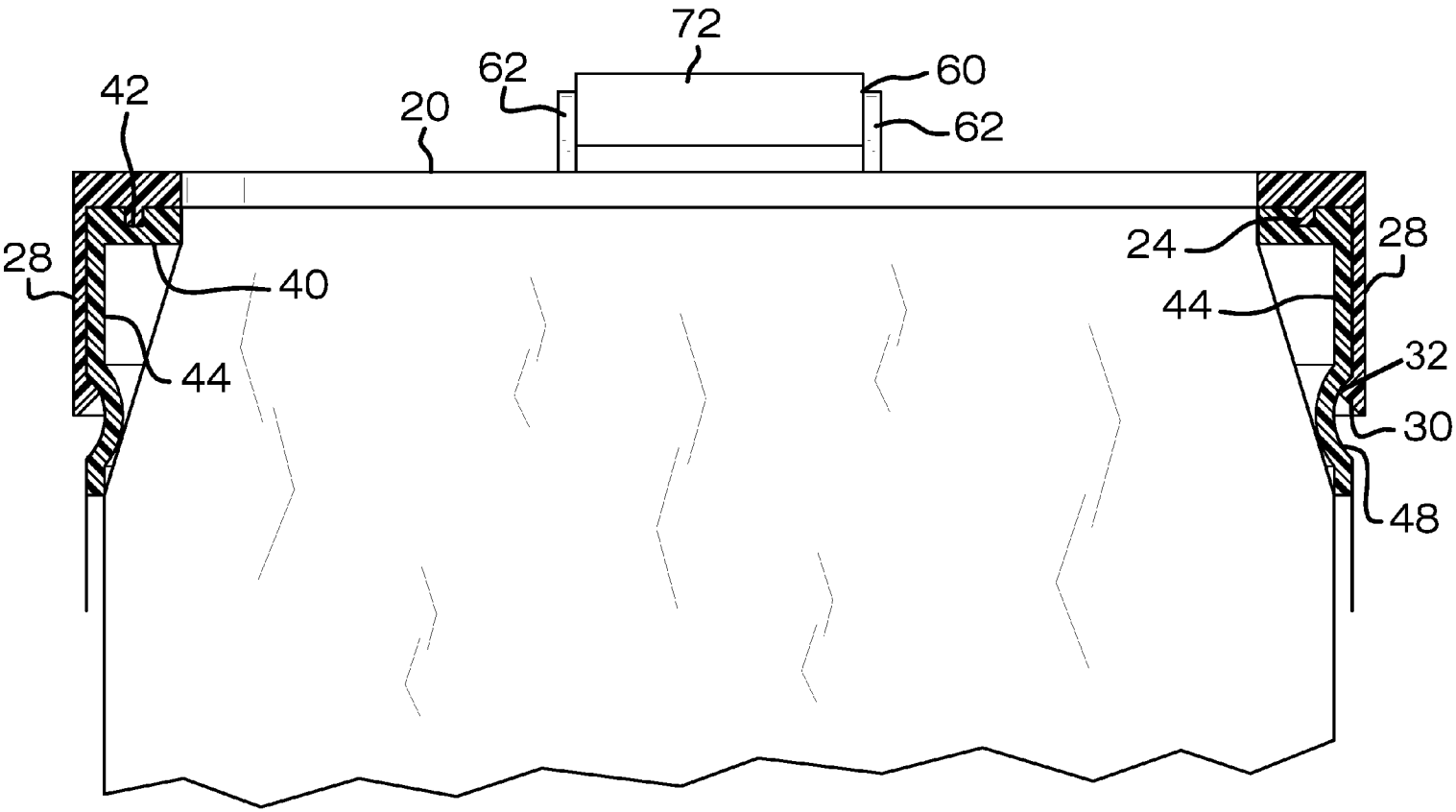
FIG. 3 is a side cross sectional view of FIG. 1, taken along the line 3-3.
Figure 4:
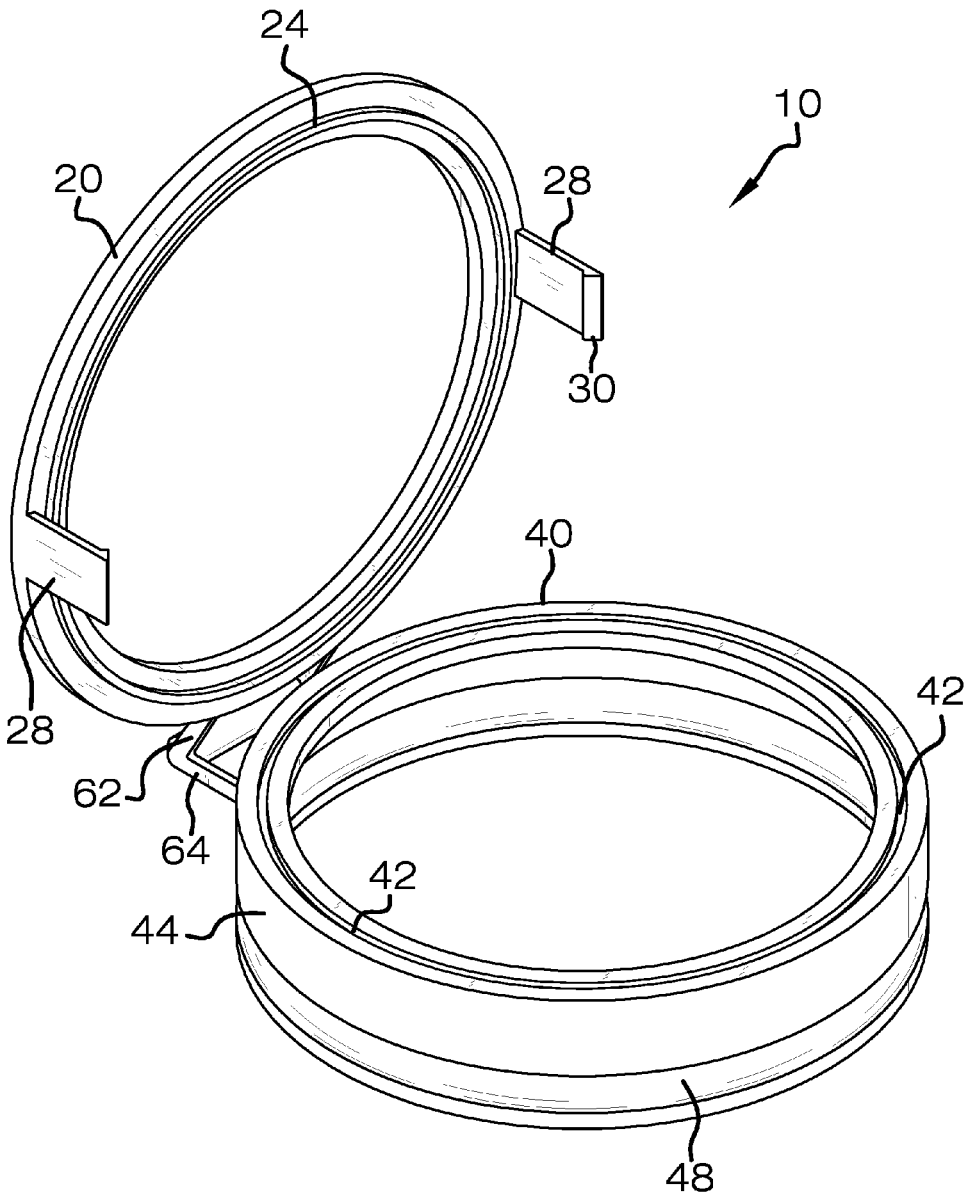
FIG. 4 is a perspective view.
Figure 5:
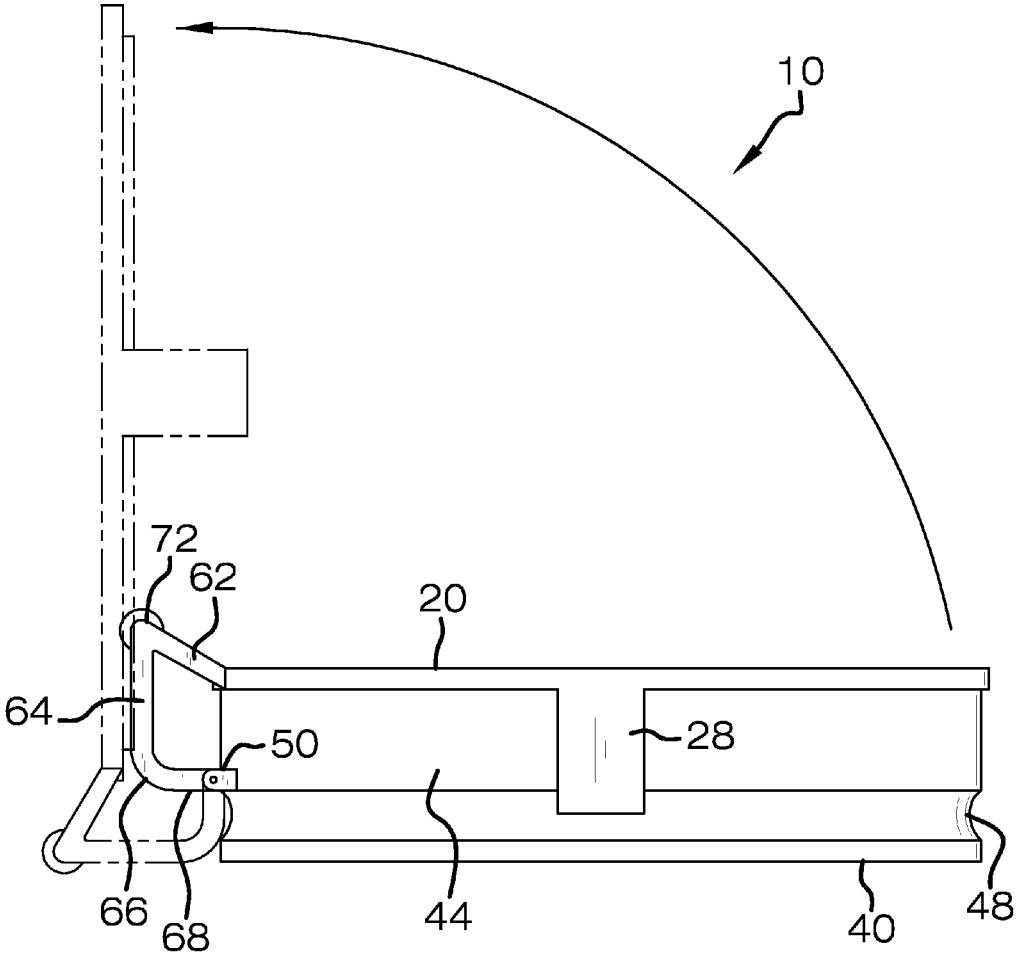
FIG. 5 is side elevation view.

With reference now to the drawings, and in particular FIGS. 1 through 5 thereof, an example of the trash bag opener employing the principles and concepts of the present trash bag opener and generally designated by the reference number 10 will be described.

Referring to FIGS. 1 through 5, the trash bag opener 10 is illustrated. The trash bag opener 10 includes a flat circular upper ring 20. An extrusion 24 is extended from an approximate center of a bottom of the upper ring 20. A pair of diametrically opposed lock extensions 28 is extended perpendicularly downward from an exterior edge of the upper ring 20. A tab 30 is extended laterally inward from a bottom of each lock extension 28. An upwardly disposed rounded edge 32 is disposed on each tab 30.

A flat circular lower ring 40 is provided. A groove 42 is disposed in a top of the lower ring 40. The groove 42 is configured to removably accept the extrusion 24 for positive engagement of the upper ring 20 with the lower ring 40. A skirt 44 is disposed perpendicularly downward from an outer perimeter of the lower ring 40. A concavity 48 is disposed within the skirt 44. The concavity 48 is configured to removably retain the tabs 30. The rounded edges 32 importantly provide ease of engagement and release of the tabs 30 with regard to the concavity 48.

A handle 60 is provided. The handle 60 includes a pair of identical spaced apart upwardly angled upper arms 62. Each upper arm 62 is connected to the upper ring 20. Each upper arm 62 is spaced apart from a horizontally disposed lower arm 68. The handle 60 is disposed centrally between the lock extensions 28. A verticality 64 connects each upper arm 62 to each lower arm 68, respectively. A rounded corner 66 connects each verticality 64 to each lower arm 68. A grip 72 connects the verticalities 64 at an approximate top of the verticalities 64. A pair of identical spaced apart ears 50 is disposed on the lower ring 40. Each ear 50 is in pivotal receipt of one of the lower arms 68, respectively, wherein the upper ring 20 is configured to pivotally engage and disengage the lower ring 40, thereby entrapping and releasing, respectively an existing trash bag.

What is claimed is:

1. A trash bag opener comprising:

a circular upper ring;

an extrusion extended from an approximate center of a bottom of the upper ring;

a pair of diametrically opposed lock extensions extended perpendicularly downward from an exterior edge of the upper ring;

a tab extended laterally inward from a bottom of each lock extension;

an upwardly disposed rounded edge on each tab;
a circular lower ring;
a groove disposed in a top of the lower ring;
wherein the groove is configured to removably accept the extrusion;
a skirt disposed perpendicularly downward from an outer perimeter of the lower ring;
a concavity disposed within the skirt;
wherein the concavity is configured to removably retain the tabs;
a handle having a pair of identical spaced apart upwardly angled upper arms, each upper arm connected to the upper ring, each upper arm spaced apart from a horizontally disposed lower arm, the handle disposed centrally between the lock extensions;
a verticality connecting each upper arm to each lower arm, respectively;
a rounded corner connecting each verticality to each horizontal arm;
a grip connecting the verticalities at an approximate top of the verticalities; and
a pair of identical spaced apart ears disposed on the lower ring, each ear in pivotal receipt of one of the lower arms; and
wherein the upper ring is configured to pivotally engage and disengage the lower ring, thereby entrapping and releasing, respectively an existing trash bag.

2. A trash bag opener comprising:
a flat circular upper ring;
an extrusion extended from an approximate center of a bottom of the upper ring;
a pair of diametrically opposed lock extensions extended perpendicularly downward from an exterior edge of the upper ring;
a tab extended laterally inward from a bottom of each lock extension;
an upwardly disposed rounded edge on each tab;
a flat circular lower ring;
a groove disposed in a top of the lower ring;
wherein the groove is configured to removably accept the extrusion;
a skirt disposed perpendicularly downward from an outer perimeter of the lower ring;
a concavity disposed within the skirt;
wherein the concavity is configured to removably retain the tabs;
a handle having a pair of identical spaced apart upwardly angled upper arms, each upper arm connected to the upper ring, each upper arm spaced apart from a horizontally disposed lower arm, the handle disposed centrally between the lock extensions;
a verticality connecting each upper arm to each lower arm, respectively;
a rounded corner connecting each verticality to each horizontal arm, each upper arm, lower arm, verticality, and rounded corner having vertically flat sides;
a grip connecting the verticalities at an approximate top of the verticalities; and
a pair of identical spaced apart ears disposed on the lower ring, each ear in pivotal receipt of one of the lower arms; and
wherein the upper ring is configured to pivotally engage and disengage the lower ring, thereby entrapping and releasing, respectively an existing trash bag.

* * * * *